US008914948B2

(12) United States Patent
Rissmeyer

(10) Patent No.: US 8,914,948 B2
(45) Date of Patent: Dec. 23, 2014

(54) SCARF ZIPPER

(71) Applicant: Teresa Rissmeyer, Fair Lawn, NJ (US)

(72) Inventor: Teresa Rissmeyer, Fair Lawn, NJ (US)

( * ) Notice: Subject to any disclaimer, the term of this patent is extended or adjusted under 35 U.S.C. 154(b) by 0 days.

(21) Appl. No.: 13/945,985

(22) Filed: Jul. 19, 2013

(65) Prior Publication Data

US 2014/0157552 A1 Jun. 12, 2014

Related U.S. Application Data

(60) Provisional application No. 61/741,398, filed on Jul. 19, 2012.

(51) Int. Cl.
*A44B 6/00* (2006.01)
*A41F 1/00* (2006.01)
*A41D 23/00* (2006.01)

(52) U.S. Cl.
CPC .. *A41F 1/00* (2013.01); *A41D 23/00* (2013.01)
USPC ..... 24/3.11; 24/3.12; 2/207; 63/40

(58) Field of Classification Search
CPC ..... A44B 6/00; A44C 5/2047; A41D 25/022; A41D 25/025; A41D 23/00; B65D 63/00; B65D 63/04; B65D 63/02; B65D 63/12; F16L 33/03; F16L 33/02; F16L 33/021; A42B 5/00
USPC ..... 24/66.8, 66.9, 66.11, 66.13, 26, 27, 28, 24/3.11, 3.12; 63/3.1, 8, 11, 23, 33, 40; 40/310; 220/320; 2/207, 279
See application file for complete search history.

(56) References Cited

U.S. PATENT DOCUMENTS

| | | | | | |
|---|---|---|---|---|---|
| 100,250 | A * | 3/1870 | Bachelder | 24/66.2 |
| 423,605 | A * | 3/1890 | Harrington | 63/11 |
| 911,583 | A * | 2/1909 | Focht | 248/94 |
| 917,791 | A * | 4/1909 | Pickhardt | 24/482 |
| 4,041,931 | A * | 8/1977 | Elliott et al. | 128/899 |
| 5,031,284 | A * | 7/1991 | Ray | 24/66.2 |
| 5,083,347 | A * | 1/1992 | Bucciero | 24/27 |
| 6,021,551 | A * | 2/2000 | Detable et al. | 24/27 |
| 6,293,034 | B1 * | 9/2001 | Skapyak et al. | 40/310 |
| 6,293,128 | B1 * | 9/2001 | Leufray-Simms | 63/23 |
| 6,530,163 | B2 * | 3/2003 | Skapyak et al. | 40/310 |
| 6,675,611 | B2 * | 1/2004 | Hunter | 63/3.1 |
| 2008/0047110 | A1 * | 2/2008 | Doyle | 24/3.12 |

* cited by examiner

*Primary Examiner* — Robert J Sandy
*Assistant Examiner* — Abigail Morrell
(74) *Attorney, Agent, or Firm* — Meister Seelig & Fein LLP

(57) ABSTRACT

A scarf zipper with a scarf securing member, a medallion member and a medallion connector member. The scarf securing member is attached to the medallion member by the medallion connector member. The scarf securing member is a wire-form component. The scarf securing member having two halves, each terminating at one end in a locking mechanism and at the opposite end in an integral spring and loop. The spring causes the halves to be biased outward from each other until locked together by the locking mechanism. The locked halves retain two panels of a standard scarf. The scarf securing member is capable of being zipped up or down by pulling on the medallion member. The scarf securing member remains in place after being zipped and the medallion member ends up at the front portion of the scarf and acts as a decorative element.

8 Claims, 8 Drawing Sheets

SCARF ZIPPER

CROSS REFERENCE TO RELATED APPLICATION

This application claims the priority of U.S. Provisional Application No. 61/741,398, entitled "SCARF ZIPPER," filed on Jul. 19, 2012, the disclosure of which is hereby incorporated by reference in its entirety.

COPYRIGHT NOTICE

A portion of the disclosure of this patent document contains material, which is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

FIELD OF THE INVENTION

The invention described herein generally relates to the field of scarf accessories and more specifically to a scarf zipper.

BACKGROUND OF THE INVENTION

Scarves are common clothing items that are worn by women or men in all parts of the world. A scarf is generally a long length of fabric that is placed over a person's neck so that two halves of the scarf hang down equally in front of the wearer's upper body.

Although scarves are generally a beautiful and decorative way of adorning the body, the two halves, or panels, can sometimes be problematic in a number of ways. First, the halves can separate at any time and potentially dislodge from the user. Second, the halves can become uneven thereby spoiling the overall appearance. Third, the scarf may not provide adequate protection from wind and cold if not held together. Various scarf rings and clasps have been developed to try to remedy this situation including designs shown in patents: U.S. Pat. No. 144,170, U.S. Pat. No. 211,594, U.S. Pat. No. 265,459, U.S. Pat. No. 430,360, U.S. Pat. No. 2,065,903, U.S. Pat. No. 2,462,727, U.S. Pat. No. 3,183,612, U.S. Pat. No. 3,890,678, U.S. Pat. No. 4,038,724, U.S. Pat. No. 5,454,121, U.S. Pat. No. 5,630,259, and U.S. Pat. No. 5,797,144.

However, the above cited designs are deficient in that they do not easily attach and detach from the scarf and are difficult to use in that the wearer has to thread the ends of the scarf halves into the small opening of a ring or clasp. Additionally, the prior art designs do not easily adjust to scarves of different thickness. And finally, the prior art does not let the user easily slide the scarf retaining device up and down with one hand.

Additionally, the prior art designs do not allow the user to easily change the appearance of the scarf securing device by removing and replacing a decorative surface plate.

SUMMARY OF THE INVENTION

An object of the invention is to provide an adjustable closure for holding two halves of a scarf together while being worn by a user. Another object of the invention is to provide an adjustable scarf closure that can be easily attached to a scarf and zipped up or down to hold scarf halves together at any height. Another object of the invention is to provide a scarf zipper that, when in use, remains in place on the scarf regardless of location. A further object of the invention is to provide a scarf zipper that will work with a variety of thickness of scarves.

Other objects and advantages of the present invention will become apparent from the following descriptions, taken in connection with the accompanying drawings, wherein, by way of illustration and example, an embodiment of the present invention is disclosed.

The present invention provides a scarf zipper comprising: a scarf securing member, a medallion member, a medallion connector member, said scarf securing member attached to said medallion member by said medallion connector member, said scarf securing member being a wire-form component, said scarf securing member having two halves, said halves each terminating at one end in a locking mechanism, said halves each terminating at the opposite end in an integral spring, said spring causing said halves to be biased outward from each other until locked together by said locking mechanism, said locked halves retaining two hanging panels of a standard scarf, said scarf securing member capable of being zipped up or down by pulling on said medallion member, said scarf securing member remaining in place after being zipped and said medallion member ending up at the front portion of said scarf and acting as a decorative element.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE INVENTION

Subject matter will now be described more fully hereinafter with reference to the accompanying drawings, which form a part hereof, and which show, by way of illustration, exemplary embodiments in which the invention may be practiced. Subject matter may, however, be embodied in a variety of different forms and, therefore, covered or claimed subject matter is intended to be construed as not being limited to any example embodiments set forth herein; example embodiments are provided merely to be illustrative. It is to be understood that other embodiments may be utilized and structural changes may be made without departing from the scope of the present invention. Likewise, a reasonably broad scope for claimed or covered subject matter is intended. The following detailed description is, therefore, not intended to be taken in a limiting sense.

Throughout the specification and claims, terms may have nuanced meanings suggested or implied in context beyond an explicitly stated meaning. Likewise, the phrase "in one embodiment" as used herein does not necessarily refer to the same embodiment and the phrase "in another embodiment" as used herein does not necessarily refer to a different embodiment. It is intended, for example, that claimed subject matter include combinations of example embodiments in whole or in part.

Figure 1:
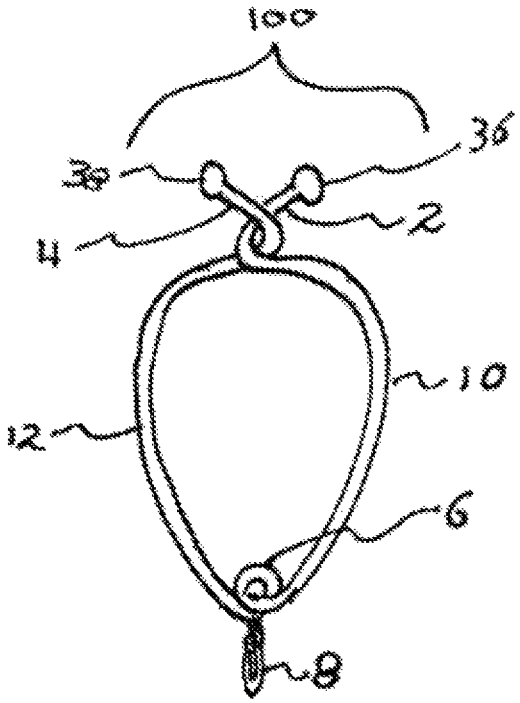
FIG. 1 illustrates a front view of the scarf securing member in the closed position according to an embodiment of the present invention.
Figure 2:
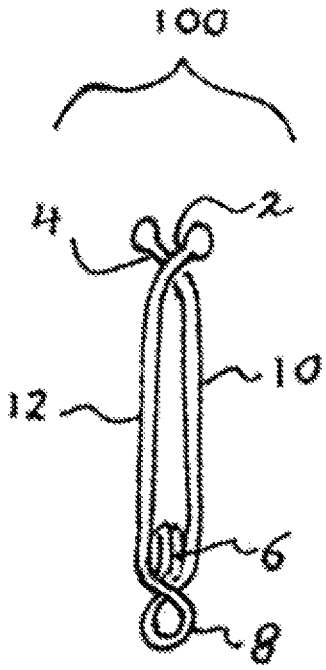
FIG. 2 illustrates a side view of the scarf securing member in the closed position according to an embodiment of the present invention.

Referring now to FIG. 1, a front view of a scarf retainer portion 100 in a closed or locked position is presented. Scarf retainer portion 100 may comprise a given length of wire shaped to form a zipper including a right retainer arm 10, a left retainer arm 12, a right closure member 2, a left closure member 4, a lower spring portion 6 and a lower loop portion 8. The wire may be constructed from any of metal, plastic, glass, or any composite material having a durable but yet flexible property allowing for opening and closure of right closure member 2 and left closure member 4. For example, scarf retainer portion 100 may be a wire-form construction made of steel spring wire. The width between right retainer arm 10 and left retainer arm 12 (herein referred to as the "body") may be constructed in various sizes to accommodate scarves of different thickness. For example, a "small" sized scarf retainer portion may include a body of a width of 1.375 inches and a height of 1.125, while a "medium" sized scarf retainer portion may include a body of width 1.875 inches and a height of 1.375 inches. Closure members 2, 4 are terminated by ball members 36, 38 which prevent the ends of the wire-form 100 from catching on a scarf or on the user's clothing. Ball members 36 and 38 may be separated by a small gap, for example, of approximately $1/16^{th}$ of an inch. FIG. 2 presents the same retainer portion 100 in the closed position from a side view.

In another embodiment, scarf retainer portion 100 may include a connector assembly (not illustrated) attached to lower loop portion 8. The connector assembly may comprise one or more of a chain, ring, hook, clasp, etc. In embodiments where the connector assembly is a chain, the chain may be varied in length according to the size of the body of scarf retainer portion. For example, a small sized retainer portion may include a chain of 1.875 inches in length and a medium sized retainer portion may include a chain of 2.1875 inches in length. Alternatively, the chain portion may be detachable portion produced in various lengths for interchangeable attachment to lower loop portion 8. The free end of the connector assembly is suitable for removable attachment of an ornamental medallion described in further detail with respect to the description of FIG. 3.

Figure 3:
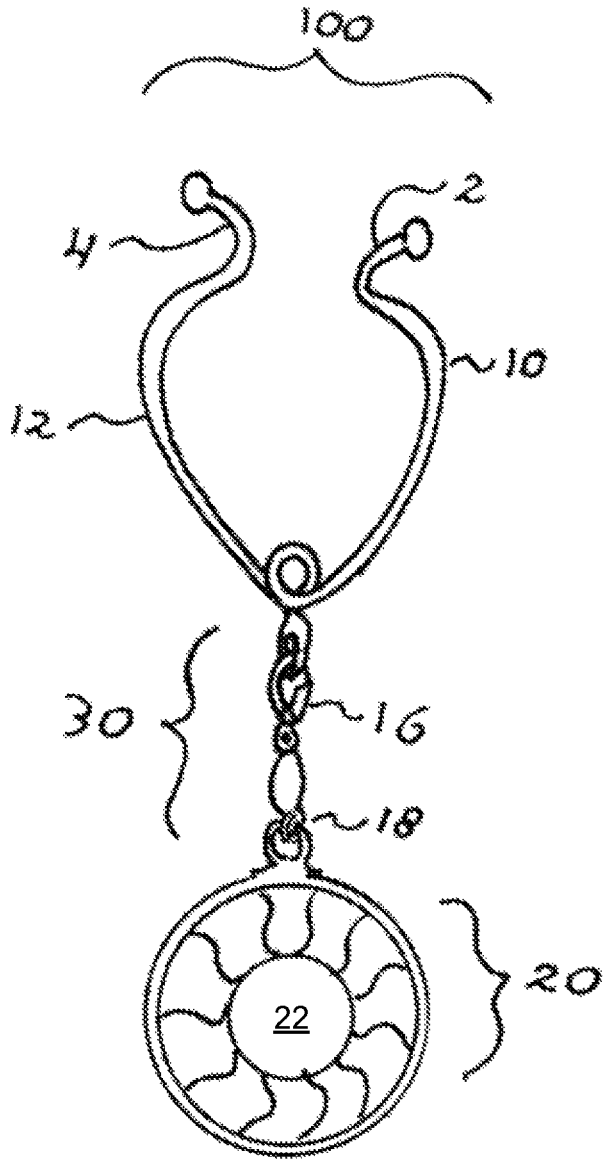
FIG. 3 illustrates a front view of the scarf securing member in the open position with attached medallion in place according to an embodiment of the present invention.

FIG. 3 presents a front view of scarf retainer portion 100 in the open position where closure members 2, 4 are sprung apart, in a biased fashion, by spring portion 6. Medallion connector portion 30 attaches the scarf retainer portion 100 to the medallion portion 20. In another embodiment, medallion connector portion 30 may be attached to a connector assembly (not illustrated) of scarf retainer portion 100. Medallion 20 may be an ornamental accessory configurable to be adapted to scarf retainer portion 100. It is important to note that the medallion portion 20 can be other three dimensional shapes such as a pendant or a sphere. The medallion connector 30 includes a claw type fastener 16 and a ring type fastener 18. It is understood that the claw type fastener 16 may fixedly attached to the scarf retainer portion 100 or to the medallion portion 20. In another embodiment, the medallion connector 30 can be a magnetic, snap, or a hook and loop type fastener, or any other suitable fasteners that are well known in the art. The medallion 20 may include a central plate 22 which can be removable and replaceable with another plate so that the medallion 20 can coordinate in color and design with specific scarves or outfits.

Figure 4:
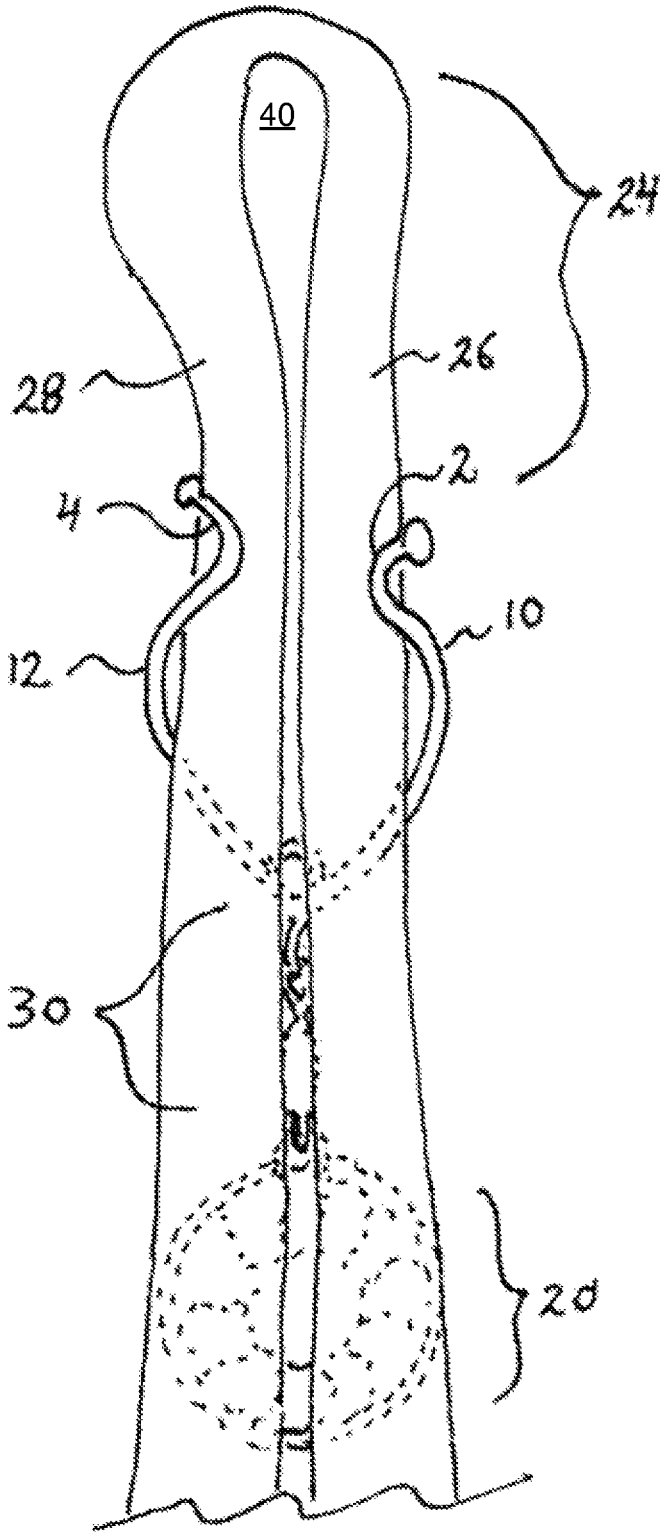
FIG. 4 illustrates a front view of a scarf being inserted into the scarf securing member according to an embodiment of the present invention.
Figure 5:
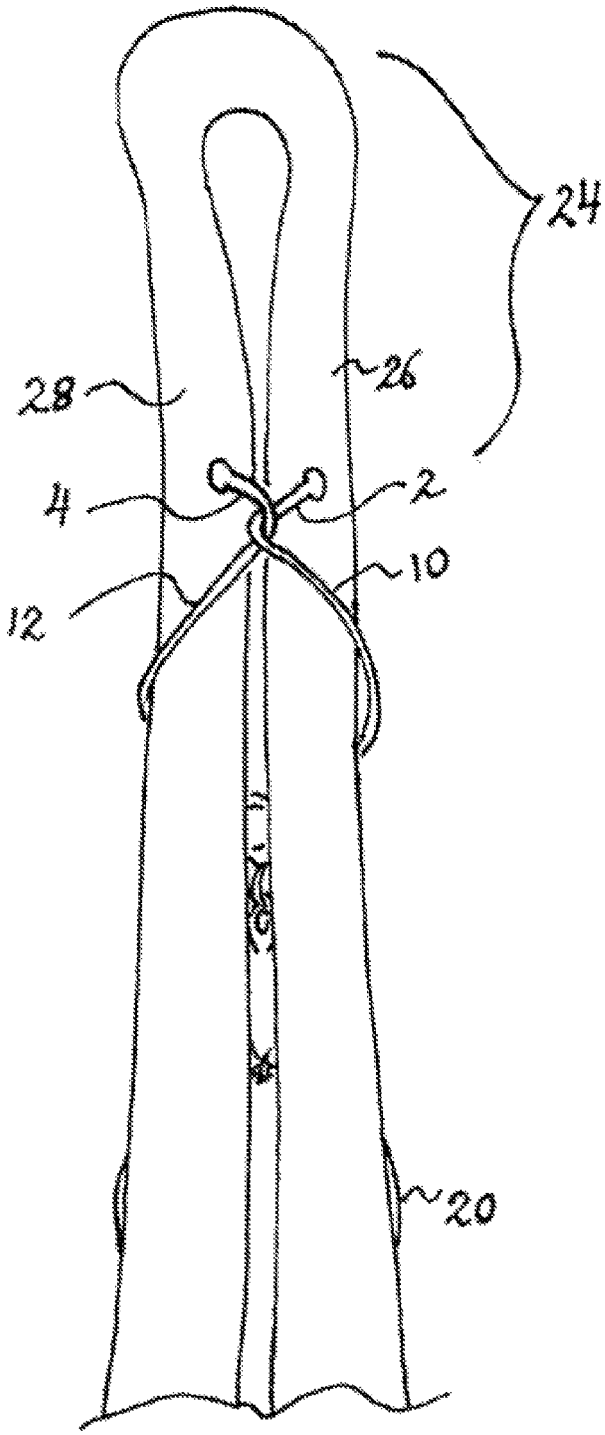
FIG. 5 illustrates a front view of the scarf locked into the scarf securing member illustrates according to an embodiment of the present invention.
Figure 6:
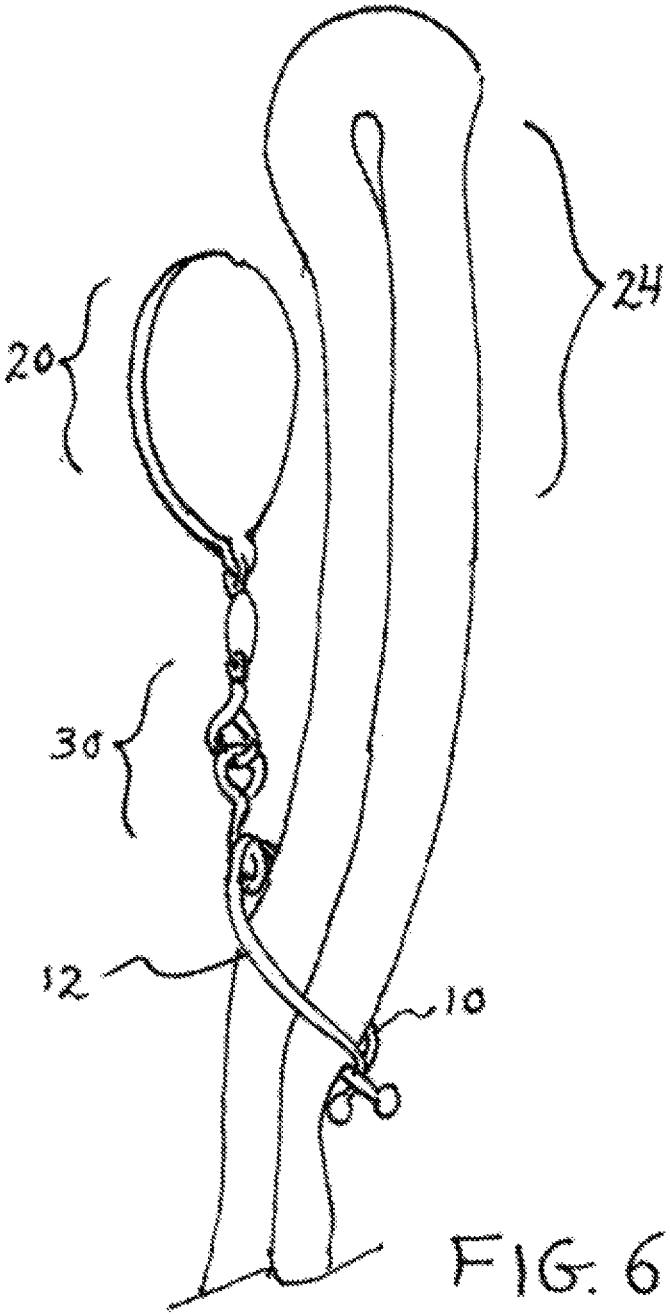
FIG. 6 illustrates a side view of the scarf securing member being pulled up by the medallion member according to an embodiment of the present invention.
Figure 7:
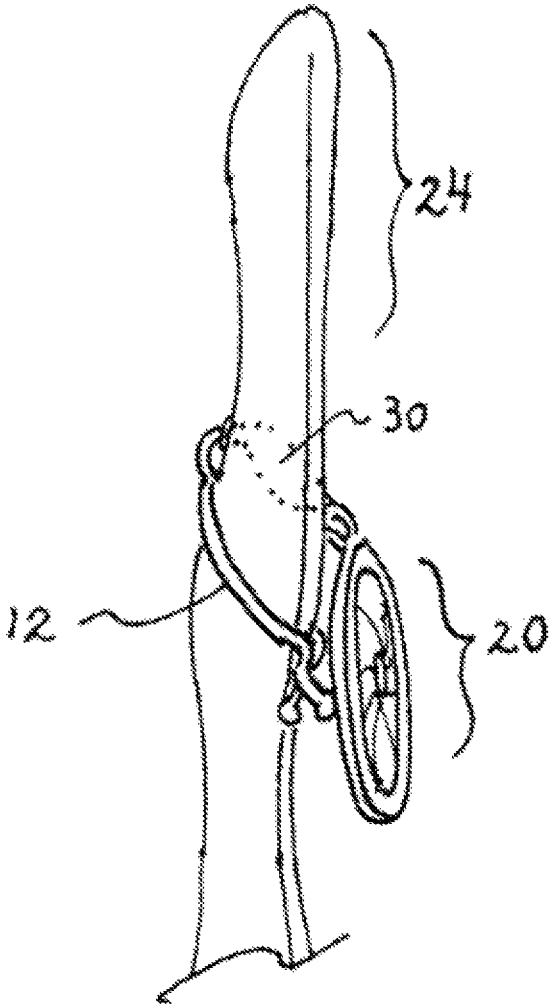
FIG. 7 illustrates a side view of the medallion member folded over so that it is in front of the scarf according to an embodiment of the present invention.
Figure 8:
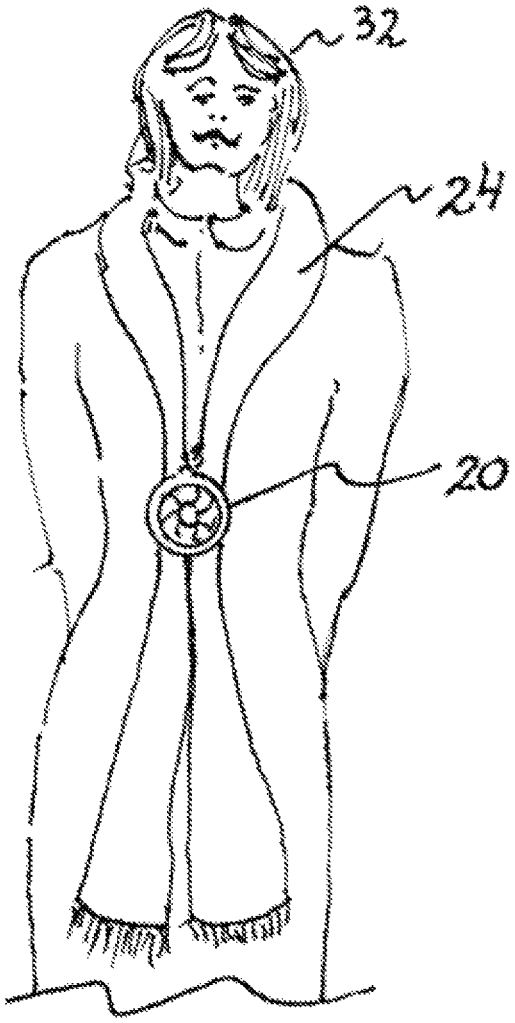
FIG. 8 illustrates a front view of a person wearing the scarf zipper of the present invention according to an embodiment of the present invention.

FIG. 4 shows a front view of a scarf 24 after it has been placed inside the retainer arms 10, 12. The present invention provides for a quick and simple procedure as compared to inserting the scarf ends into a ring like retaining device as shown in the prior art. The medallion connector 30 and medallion 20 are shown in phantom view as they reside behind scarf panels 26, 28. The user's neck would be located in area 40 and panels 26, 28 would hang down in front of the wearer 32 as shown in FIG. 8. After the user places scarf panels 26, 28 inside the scarf retainer portion 100, he or she may close the right closure member 2 and left closure member 4, as shown in FIG. 5. The user may then pull up on medallion member 20 as shown in FIG. 6 causing the medallion connector 20 and the retainer portion 100 to rise. The user can also pull down on the medallion 20 to lower the scarf retainer portion 100. When the user has the scarf retainer portion at the desired height, he or she may rotate the medallion 20 from the back side of the scarf 24 to the front side of the scarf 24 as shown in side view in FIG. 7 and in front view in FIG. 8. The retainer portion 100 is substantially or completely hidden in a closed and prepared configuration as shown in FIG. 8, and the medallion 20 acts as a decorative accent piece to compliment the scarf 24 and the rest of the outfit that the user may be wearing.

The entire assembly 100, 20, 30 remains in place on the scarf without slipping down due to the weight of medallion 20 and the counter forces imposed on scarf retainer portion 100. However the user can raise or lower the retainer 100 easily and quickly, or the user can remove the retainer 100 quickly by unlocking closure members 2, 4. The entire assembly 100, 20, 30 is relatively inexpensive to manufacture and therefore can sell for a very competitive price in comparison to other less desirable devices that may hold a scarf closed.

FIGS. 1 through 8 are conceptual illustrations allowing for an explanation of the present invention. The foregoing description of the specific embodiments will so fully reveal the general nature of the invention that others can, by applying knowledge within the skill of the relevant art(s) (including the contents of the documents cited and incorporated by reference herein), readily modify and/or adapt for various applications such specific embodiments, without undue experimentation, without departing from the general concept of the present invention. Such adaptations and modifications are therefore intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance presented herein, in combination with the knowledge of one skilled in the relevant art(s).

While various embodiments of the present invention have been described above, it should be understood that they have been presented by way of example, and not limitation. It would be apparent to one skilled in the relevant art(s) that various changes in form and detail could be made therein without departing from the spirit and scope of the invention. Thus, the present invention should not be limited by any of the above-described exemplary embodiments, but should be defined only in accordance with the following claims and their equivalents.

What is claimed is:

1. A scarf zipper comprising:

a scarf securing member;

a medallion member;

a medallion connector member;

said scarf securing member attached to said medallion member by said medallion connector member;

said scarf securing member being a wire-form component;

said scarf securing member having two halves;

said halves terminating at one end in a locking mechanism;

said halves terminating at the opposite end in an integral spring said spring causing said halves to be in an open position until locked together by said locking mechanism;

said locked halves retaining two hanging portions of a scarf;

said scarf securing member capable of being zipped up and down by pulling on said medallion member;

said scarf securing member remaining in place after being zipped; and said medallion member configurable in a front portion of said scarf to serve as a decorative element.

2. The scarf zipper of claim 1 wherein the scarf securing member includes a connector assembly.

3. The scarf zipper of claim 2 wherein the connector assembly is one or more of a chain, ring, hook, and clasp.

4. The scarf zipper of claim 2 wherein the connector assembly of the scarf securing member is attached to the medallion member by the medallion connector member.

5. The scarf zipper of claim 1 wherein a substantial portion of the scarf retainer is hidden in a prepared configuration.

6. The scarf zipper of claim 1 wherein said medallion connector member includes a claw type fastener and a ring type fastener.

7. The scarf zipper of claim 1 wherein the medallion member includes a removable central plate.

8. The scarf zipper of claim 1 wherein the medallion member is detachable from the scarf securing member by the medallion connector member.

* * * * *